United States Patent [19]

Lane

[11] 4,234,167

[45] Nov. 18, 1980

[54] AUTOMATIC INHAUL WINCH SYSTEM

[75] Inventor: William C. Lane, Dallas, Tex.

[73] Assignee: Otis Engineering Corporation, Dallas, Tex.

[21] Appl. No.: 934,797

[22] Filed: Aug. 18, 1978

[51] Int. Cl.[3] ..... B66D 1/76

[52] U.S. Cl. ..... 254/291; 254/295; 254/309

[58] Field of Search ..... 254/175.7, 175.5, 187.1, 254/187.2, 187.3, 187.4, 187.5, 187.6, 187.7, 172, 173; 242/45, 67.2

[56] References Cited

U.S. PATENT DOCUMENTS

| | | | |
|---|---|---|---|
| 3,020,022 | 2/1962 | Turnquist | 254/175.7 |
| 3,250,490 | 5/1966 | Gleeson | 242/86.51 |
| 3,250,491 | 5/1966 | Stalker | 242/86.51 |
| 3,250,492 | 5/1966 | Hlinsky et al. | 242/86.51 |
| 3,300,187 | 1/1967 | Saxe et al. | 254/175.7 X |
| 3,309,064 | 3/1967 | Muller et al. | 254/175.7 X |
| 3,388,890 | 6/1968 | Born et al. | 254/175.7 |
| 3,399,868 | 9/1968 | Reischl | 254/175.7 |
| 3,606,257 | 9/1971 | Wilson | 254/175.7 |
| 3,738,614 | 6/1973 | Peterson | 254/187.7 |

*Primary Examiner*—John M. Jillions
*Attorney, Agent, or Firm*—Thomas R. Felger

[57] ABSTRACT

An improved winch system to automatically inhaul or retrieve flexible line during a slack line condition. The winch system utilizes a traction unit to control the pay out and retrieve the flexible line when the flexible line is subject to normal loading. When the load on the flexible line drops below a preselected value, a spooling unit can retrieve the flexible line through the traction unit at an accelerated rate to prevent fouling of the flexible line.

8 Claims, 4 Drawing Figures

AUTOMATIC INHAUL WINCH SYSTEM

BACKGROUND OF THE INVENTION

1. Field of the Invention

The present invention is directed towards an improved winch system. A winch system, used to control flexible line, frequently encounters problems when the direction of load movement suddenly changes creating slack line. The slack line can become fouled in the winch system or entangled with other objects in the area.

2. Description of the Prior Art

Many devices have been designed to compensate for slack line in a winch system. U.S. Pat. Nos. 3,250,490; 3,250,491; and 3,250,492, assigned to Goodman Manufacturing Company, disclose improvements in hydraulic drive and control circuits for cable reels. The above patents do not disclose any device or system to minimize slack line problems in a winch system comprising a traction unit and a storage unit.

SUMMARY OF THE INVENTION

The present invention relates generally to an improved winch system for paying out and retrieving a flexible line attached to a load having a traction unit and a spooling unit, wherein the improvement comprises means for operating said spooling unit to impose tension on said flexible line, means for driving said traction unit to control the pay out and retrieve said flexible line, and an overrunning clutch means installed within said driving means whereby said storage unit can retrieve said flexible line when said load on said flexible line is less than said tension imposed by said operating means.

One object of the present invention is to provide an improved winch system which can quickly retrieve flexible line when the line becomes slack.

Another object of the present invention is to provide an improved winch system which can automatically retrieve flexible line without a complicated control system when the load on the line drops below a preselected value.

Still another object of the present invention is to provide an improved winch system having an overrunning clutch means installed in the drive train between the capstan motor and capstan heads.

These and other objects and advantages of this invention will become apparent from the drawings, the claims, and the detailed description which follows.

BRIEF DESCRIPTION OF THE DRAWINGS

In the drawings, like numerals indicate like parts and an illustrative embodiment of the present invention is shown.

DESCRIPTION OF THE PREFERRED EMBODIMENT

Figure 1:
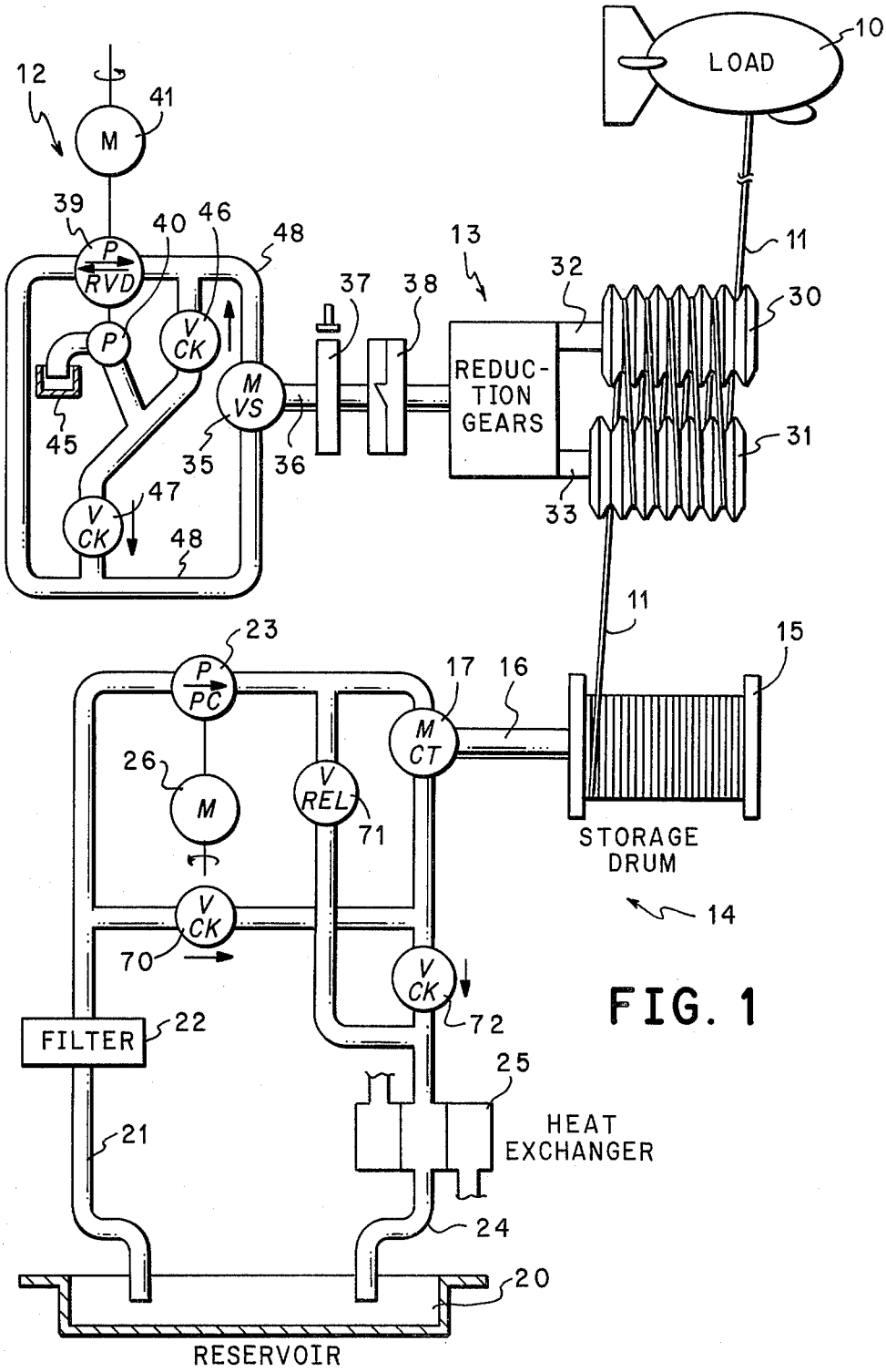
FIG. 1 is a schematic view showing the improved winch system controlling a balloon attached to a flexible line.

Referring to the drawings and particularly FIG. 1, balloon 10 is shown attached to flexible line 11. Under normal conditions, balloon 10 has positive bouyancy which causes it to rise and to place a load on flexible line 11. During adverse weather conditions, such as rain, balloon 10 may lose its positive buoyancy and descend rapidly. During this sudden change in load, flexible line 11 will become slack and may become fouled in the winch system 12 or with other objects in the vicinity. The problem of slack line is present in any winch system which controls a load that can suddenly change directions of movement. Examples of winch systems in which the present invention is usable in addition to balloon mooring systems are deep sea diving winches, underway replenishment winches, and winches controlling electrical power cables attached to moving vehicles.

Winch system 12 has two major components, traction unit 13 and spooling unit 14. Traction unit 13 is designed to control the pay out and to retrieve flexible line 11 when subjected to a heavy load. In order to handle the resulting high torque, the rate of movement of flexible line 11 by traction unit 13 is slightly reduced. Spooling unit 14 operates at a lower torque and a slightly higher rate as compared to traction unit 13.

Spooling unit 14 includes a storage drum or reel 15 which stores flexible line 11. Storage drum 15 is rotatably mounted on shaft 16. Constant torque motor 17 is rotatably coupled with shaft 16 to rotate storage drum 15 in a direction to retrieve or inhaul line 11. Preferably storage drum 15 will be of the type having an internal brake which could be set to prevent rotation of drum 15 if desired. As shown in FIG. 1, constant torque motor 17 is operated by a hydraulic power system although an electrical motor could also be used with the present invention. Constant torque motor 17 provides a means for operating spooling unit 14 to impose tension on flexible line 11. The actual value of the tension imposed on flexible line 11 between spooling unit 14 and traction unit 13 is a function of the torque on shaft 16 divided by the moment arm of reel 15. The moment arm varies within limits as flexible line 11 is retrieved and payed out from reel 15. Therefore, constant torque motor 17 can impose tension on flexible line 11 within preselect values.

The hydraulic power system includes reservoir 20 for providing a source of hydraulic fluid. Hydraulic fluid is withdrawn from reservoir 20 through suction conduit 21. After leaving reservoir 20, the hydraulic fluid flows through filter 22 and then to either pressure compensated pump 23 or constant torque motor 17. Hydraulic fluid is returned to reservoir 20 by return conduit 24 after passing through heat exchanger 25. Pressure compensated pump 23 is driven by prime mover 26 which could be a diesel or gasoline engine.

Traction unit 13 includes multiple grooved capstan heads 30 and 31. The present invention can be used with any type of capstan having a single or dual capstan heads with or without grooves. Flexible line 11 is run from storage unit 14 through traction unit 13 by wrapping line 11 around capstans 30 and 31. Under normal loading conditions, capstans 30 and 31 control the pay out and retrieval of flexible line 11.

Capstan heads 30 and 31 are mounted on and rotated by shafts 32 and 33 which extend from reduction gears 34. The capstan heads are driven by a capstan motor 35. The drive train between motor 35 and the capstan heads 30 and 31 comprises a drive shaft 36 with brake 37 mounted thereon, reduction gears 34, and an overrunning clutch means 38 between brake 37 and reduction gears 34. Capstan motor 35 can be electrical, pneumatic, or hydraulically powered. In FIG. 1, a reversible direction hydraulic pump 39 is shown supplying operating fluid to capstan motor 35. Hydraulic pump 39 and charging pump 40 are both mounted on a common shaft and driven by prime mover 41. Charging pump 40 takes a suction on reservoir 45 and discharges hydraulic fluid through either check valve 46 or 47 to maintain loop 48 between pump 39 and motor 35 full of fluid. Loop 48 can contain, as desired, standard items for a hydraulic fluid system such as an accumulator to dampen pressure surges and isolation valves to allow repair and replacement of major components. Preferably, pump 40 would have a constant displacement with an internal relief path back to reservoir 45. Prime mover 41 can be either a diesel or gasoline motor. A single prime mover can be used in place of prime movers 26 and 41. Reservoir 45 and reservoir 20 can be replaced by a single reservoir.

Figure 2:
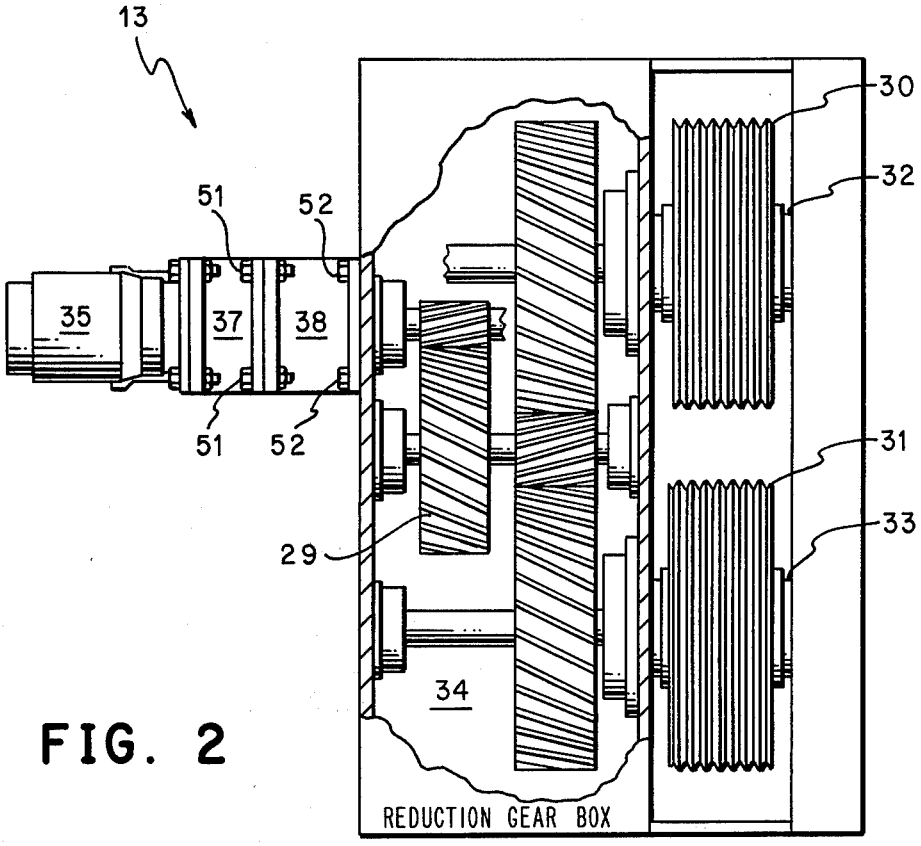
FIG. 2 is a schematic view showing the traction unit of the improved winch system with the reduction gear box partially cut away.

In FIG. 2, overruning clutch means 38 is shown installed in the drive train exterior to the reduction gears 34. In some winch systems, it might be desirable to install the overruning clutch within the reduction gears such as on the hub of bull gear 29. In other winch systems, it may be desirable to install the overrunning clutch as part of the shafts for rotatably mounting the capstans such as shafts 32 and 33.

Figure 4:
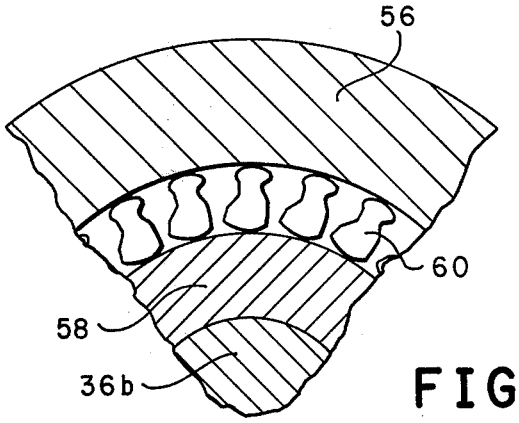
FIG. 4 is a schematic view showing a partial cross section of one type of overrunning clutch means satisfactory for use in the present invention.
Figure 3:
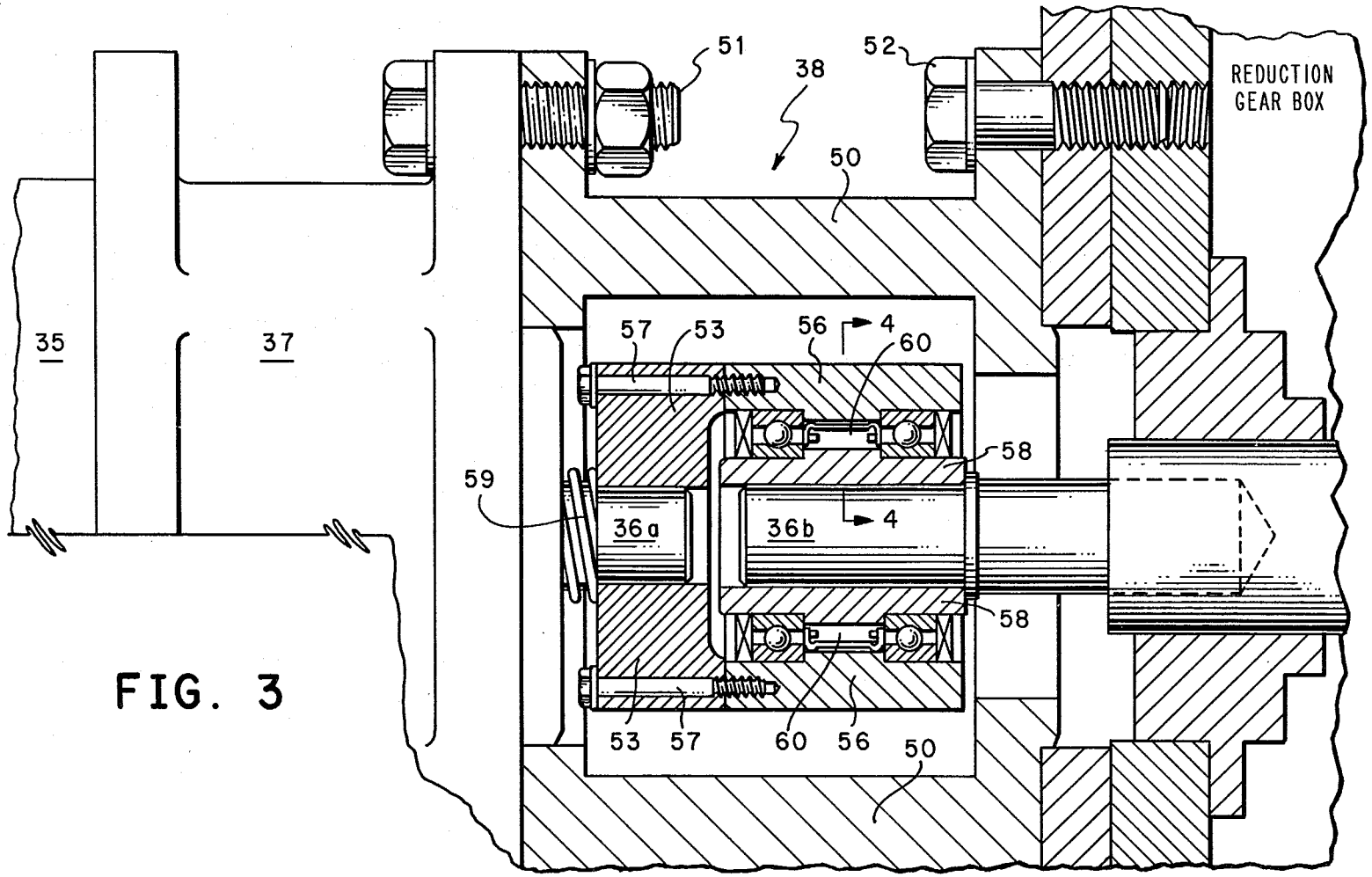
FIG. 3 is a schematic view, partially in section showing the overrunning clutch means installed in the drive train between the capstan motor and the reduction gears.

As best shown in FIGS. 3 and 4, overruning clutch means 38 can transmit torque from capstan motor 35 to reduction gears 34 in only one direction. Clutch 38 is installed so that the transmitted torque from motor 35 will rotate reduction gears 34 and capstans 30 and 31 in a direction to retrieve flexible line 11. Various overrunning clutches are satisfactory for use in the present invention. One such clutch is a FORMSPRAG (Trademark Registered) overrunning clutch as shown in Dana Corporation Industrial Power Transmission Divisions catalog 2106 published January 1978.

Clutch housing 50 is connected to brake 37 by bolts 51 and to the reduction gear box by bolts 52. Drive shaft 36 has two separate portions 36*a* and 36*b* which are rotatably coupled within housing 50. Drive shaft 36*a* is rotated by capstan motor 35. Clutch adapter flange 53 is slidably keyed to the end of drive shaft 36*a* within housing 50. Outer race 56 of clutch means 38 is bolted to adapter flange 53 by bolts 57. Inner race 58 of clutch means 38 is slidably keyed to the end of drive shaft 36*b* within housing 50. Spring 59 is installed around drive shaft 36*a* between brake 37 and clutch adapter flange 53 to maintain proper positioning of outer race 56 and inner race 58 within housing 50. Sprags 60 are disposed in the annular space between outer race 56 and inner race 58. The shape and spacing of sprags 60 permit torque to be transmitted in only one direction from outer race 56 to inner race 58.

Normal Operation

With a load such as balloon 10 attached, flexible line 11 is normally in tension. Brake 37 can engage operating shaft 36 to hold the load and to prevent the payout of flexible line 11. When it is desired to pay out flexible line 11, brake 37 is released and load 10 will attempt to pull line through dual capstans 30 and 31. Rotation of the capstans is transmitted through reduction gears 34 and clutch means 38 by operating shaft 36 to capstan motor 35. If capstan motor 35 is not free to rotate, flexible line 11 cannot pay out. By varying the rate and direction of fluid discharged by pump 39, the speed of rotation of motor 35 can be controlled and thus the rate of paying out flexible line 11. If hydraulic fluid flow in loop 48 was blocked, motor 35 could not rotate.

While paying out flexible line 11, pump 23 in the hydraulic power system supplying operating fluid to spooling unit 14 is idling. Balloon 10 pulls line through traction unit 13 which rotates storage drum 15 and constant torque motor 17 through operating shaft 16. During pay out, motor 17 rotates in the opposite direction from when pump 23 is supplying operating fluid to take up flexible line 11. Reverse rotation of motor 17 causes the motor to act as a pump drawing fluid from reservoir 20 through suction conduit 21, filter 22 and check valve 70. During pay out, motor 17 discharges fluid through relief valve 71 into heat exchanger 25 and back to reservoir 20 via return conduit 24. The hydraulic fluid discharged by motor 17 opposes any fluid which pump 23 may attempt to discharge. Therefore, pump 23 idles during pay out but automatically discharges fluid to impose a tension on flexible line 11 as soon as traction unit 13 stops paying out line 11. Relief valve 71 maintains a constant pressure in the conduit connecting pump 23 and motor 17 when either the pump or the motor is discharging fluid. Check valve 72 blocks flow from relief valve 71 from returning to constant torque motor 17.

When it is desired to retrieve balloon 10 under normal conditions, pump 39 discharges fluid in a direction to rotate capstan motor 35 and drive shaft 36 to inhaul flexible line 11. Overrunning clutch means 38 is installed to transmit torque in this direction from capstan motor 35. Clutch means 38 is oriented to allow capstan motor 35 and/or brake 37 to resist the load placed on flexible line 11 by balloon 10. This orientation permits traction unit 13 to inhaul flexible line 11 when subjected to normal loading. The direction of torque transmission is the same when fluid flow through motor 35 is being throttled by pump 39 to control pay out of line 11 or when pump 39 is discharging fluid to retrieve line 11.

Pressure compensated pump 23 discharges fluid from reservoir 20 to constant torque motor 17 to rotate storage drum 15 in a direction to take up flexible line 11 as it is retrieved by traction unit 13. Check valve 70 prevents fluid exiting from motor 17 from returning to pump 23 without flowing through heat exchanger 25, reservoir 20 and filter 22. Also, relief valve 71 prevents the discharge pressure from pump 23 from exceeding a preselected value.

By maintaining an essentially constant discharge pressure from pump 23, motor 17 produces an essentially constant torque on shaft 16. As previously stated, hydraulic motor 17 could be replaced by an electric motor designed to produce a constant torque output.

Automatic or Emergency Inhaul

During adverse weather conditions, balloon 10 may suddenly start to descend creating an excessive amount of slack in flexible line 11. When the tension on flexible line 11 created by balloon 10 drops below the tension imposed on flexible line 11 by constant torque motor 17, overrunning clutch means 38 will slip and isolate capstan heads 30 and 31 from brake 37 and capstan motor 35. Spooling unit 14 can thus inhaul flexible line 11 without the assistance of traction unit 13. Constant torque motor 17 provides a means to retrieve flexible line 11 at a high rate and low torque as compared to capstan motor 35.

With the combination of overrunning clutch means 38 and constant torque motor 17, personnel assigned to winch system 12 do not have to be constantly alert for changes in the direction of load movement. Clutch means 38 provides means for the automatic inhaul of flexible line 11 without an elaborate control system built into traction unit 13. Automatic inhaul starts, accelerates, and decelerates, and stops as required to maintain tension on flexible line 11 between traction unit 13 and spooling unit 14 within preselected values.

The present invention can be readily adapted to control flexible line attached to any load which can suddenly change direction of movement. The previous description is illustrative of only one embodiment of the present invention. Changes and modifications may be made without departing from the scope of the invention as defined in the claims.

What is claimed is:

1. An improved winch system for paying out and retrieving a flexible line attached to a load having a traction unit and a spooling unit, wherein the improvement comprises:

a. means for operating said spooling unit to impose tension on said flexible line;

b. means for driving said traction unit to control the pay out and retrieve said flexible line; and c. an overrunning clutch means installed within said driving means and transmitting torque from said driving means in only one direction to retrieve said flexible line whereby said spooling unit can retrieve said flexible line when said load on said flexible line is less than said tension imposed by said operating means.

2. An improved winch system as recited in claim 1 wherein said operating means further comprises:

a constant torque motor.

3. An improved winch system as recited in claim 1 wherein said traction unit further comprises:

a. multiple grooved capstan heads;

b. a capstan motor; and c. a drive train connecting said capstan motor to said capstan heads and said overrunning clutch forming a portion of said drive train.

4. An improved winch system, for paying out and retrieving a flexible line attached to a load, of the type having a storage drum and dual capstans with the flexible line running from the storage drum through the capstans and to the load, wherein the improvement comprises:

a. a constant torque motor coupled to the storage drum to take up line from the capstans;

b. a capstan motor coupled to the capstans to rotate the capstans to control paying out and to retrieve the flexible line;

c. reduction gears rotatably connected to the capstans;

d. a drive train connecting the capstan motor to the reduction gears and an overrunning clutch means installed in the drive train between the capstan motor and the reduction gears; and e. the overrunning clutch means transmitting torque, when the load on the flexible line exceeds a preselected value, from the capstan motor to the reduction gears which rotate the capstans whereby the constant torque motor can rotate the storage drum to retrieve the flexible line through the capstans when the load on the flexible line drops below the preselected value.

5. An improved winch system as recited in claim 4, further comprising:

hydraulic power systems to operate the capstan motor and the constant torque motor.

6. An improved winch system for paying out and retrieving a flexible line attached to a load, having a traction unit and a spooling unit, wherein the improvement comprises:

a. means for operating said spooling unit to take up said flexible line;

b. means for driving said traction unit to control the pay out and to retrieve said flexible line;

c. an overrunning clutch means installed within said driving means; and d. said overrunning clutch transmitting torque between said drive means and said traction unit only when the tension on said flexible line exceeds a predetermined value.

7. An improved winch system as defined in claim 6 wherein said traction unit and the means for driving said traction unit, further comprises:

a. dual capstans;

b. a capstan motor rotatably connected to said dual capstan by a drive train including reduction gears; and c. said overrunning clutch means installed in the drive train between said capstan motor and said reduction gears.

8. An improved system as recited in claim 6, further comprising hydraulic power systems to operate said traction unit and said spooling unit.

* * * * *